US009010619B2

(12) United States Patent
Makofsky et al.

(10) Patent No.: US 9,010,619 B2
(45) Date of Patent: Apr. 21, 2015

(54) EXPANDABLE FILE HOLDER

(75) Inventors: Marvin A. Makofsky, Sands Point, NY (US); Robert Makofsky, New York, NY (US); Sari Makofsky McConnell, Burlingame, CA (US)

(73) Assignee: Conformer Products, Inc., Great Neck, NY (US)

( * ) Notice: Subject to any disclaimer, the term of this patent is extended or adjusted under 35 U.S.C. 154(b) by 13 days.

(21) Appl. No.: 13/536,153

(22) Filed: Jun. 28, 2012

(65) Prior Publication Data

US 2014/0001245 A1 Jan. 2, 2014

(51) Int. Cl.
*B65D 27/00* (2006.01)
*B42F 7/02* (2006.01)

(52) U.S. Cl.
CPC ..... *B42F 7/02* (2013.01)

(58) Field of Classification Search
CPC ..... B65D 5/0005; B65D 27/00; B65D 27/34; B65D 31/005; Y10S 229/928
USPC ..... 229/67.3, 928, 87.18, 87.19, 307, 405; 383/120, 122
See application file for complete search history.

(56) References Cited

U.S. PATENT DOCUMENTS

| | | | | | |
|---|---|---|---|---|---|
| 960,384 | A * | 6/1910 | Norman | 229/68.1 |
| 2,899,874 | A * | 8/1959 | Normandin | 493/241 |
| 3,073,508 | A * | 1/1963 | Hiersteiner | 229/67.3 |
| 3,144,979 | A * | 8/1964 | Young | 206/521 |
| 3,648,923 | A * | 3/1972 | Young | 229/67.3 |
| 3,860,164 | A * | 1/1975 | Dworkin | 383/122 |
| 3,944,131 | A * | 3/1976 | Weiss | 206/521 |
| 3,955,749 | A * | 5/1976 | Turkenkopf | 383/122 |
| 4,008,650 | A * | 2/1977 | Alter et al. | 493/241 |
| 6,227,444 | B1 * | 5/2001 | Makoesky et al. | 229/313 |
| 2008/0041924 | A1 * | 2/2008 | Christensen et al. | 229/67.3 |
| 2010/0327048 | A1 * | 12/2010 | Tsai | 229/200 |

* cited by examiner

*Primary Examiner* — Jes F Pascua
(74) *Attorney, Agent, or Firm* — Francis C. Hanos; Carella, Byrne, & Agnello

(57) ABSTRACT

The file holder is closed on two or three sides and is made from a single one piece blank. The bottom corners of the file holder are reinforced to avoid popping out when filled to capacity. The blank may be used to make a file folder or a mailer.

23 Claims, 6 Drawing Sheets

EXPANDABLE FILE HOLDER

This application relates to an expandable file holder.

As is known, there are various types of file folders such as those described in U.S. Pat. No. 7,644,857. Typically, the file folders are formed of two sides that are interconnected by expansion members in the form of accordion pleats. When such folders are filled with documents and things, the accordion pleats expand to accommodate the size of the documents and things. One of the problems associated with this type of file folder is that after some periods of use the accordion pleats tend to project beyond the plane of the folder so that when placed in a filing cabinet, the projecting pleats catch on the filing cabinet. In addition, the fabrication of such file folders is relatively expensive since the accordion pleats are required to be separately made from the two sides of the folder and then assembled together.

Another common file folder is formed of two sides that are interconnected without accordion pleats. Such file folders are limited in capacity and exhibit limited functionality as a result.

Accordingly, it is an object of this invention to provide an expandable file folder that can be made from a single one-piece blank.

It is another object of the invention to provide an expandable file folder that can be readily fabricated on automated equipment.

It is another object of the invention to provide a flat expandable file folder that can be filled to capacity while retaining a flat appearance.

It is another object of the invention to provide an expandable file folder that can be readily fitted into another hanging file holder and/or filing cabinet for storage.

Briefly, the invention provides an expandable file holder comprised of a back panel of rectangular shape; a front panel extending from a bottom edge of the back panel and folded over the back panel to define a pocket, and a pair of side flaps secured to the front panel.

In accordance with the invention, the front panel has a horizontally disposed score line spaced from a bottom edge to divide the front panel into a first rectangular section extending from the back panel and a second rectangular section. In addition, the first rectangular section has an angular score line at each respective longitudinal end thereof to define a triangular tab.

In addition, each side flap extends from a side edge of the back panel and has a vertical score line dividing the side flap into a first section extending from the back panel and a second section. Adhesive means secures the second section of each flap to the front panel. In this respect, the side flaps may be adhered under the front panel or on top of the front panel.

These and other objects and advantages of the invention will become more apparent from the following detailed description taken in conjunction with the accompanying drawings wherein.

Figure 1:
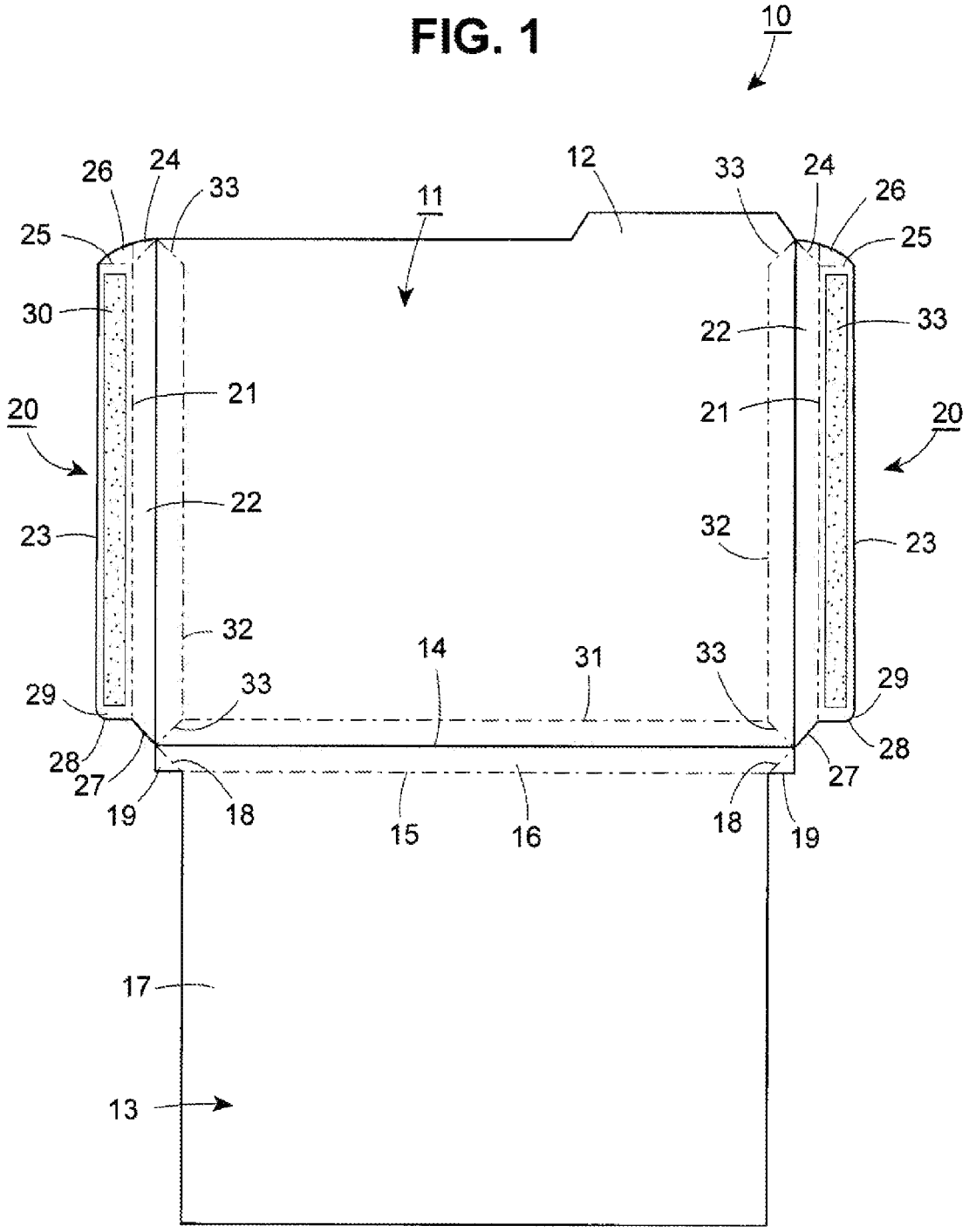
FIG. 1 illustrates a view of a blank used to make a pocket folder in accordance with the invention.
Figure 3:
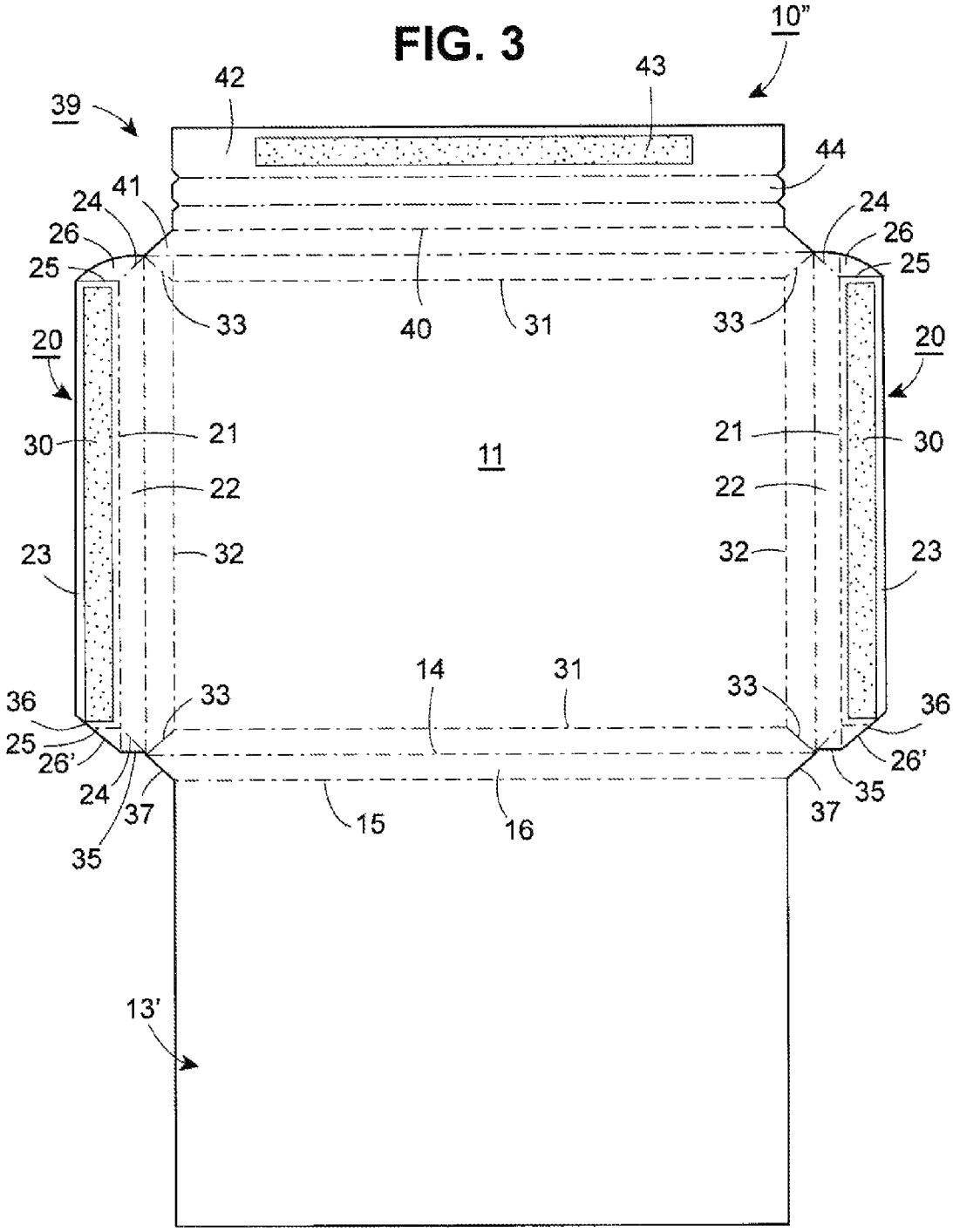
FIG. 3 illustrates a view of a modified blank for making a pocket folder or a mailer in accordance with the invention.
Figure 4:
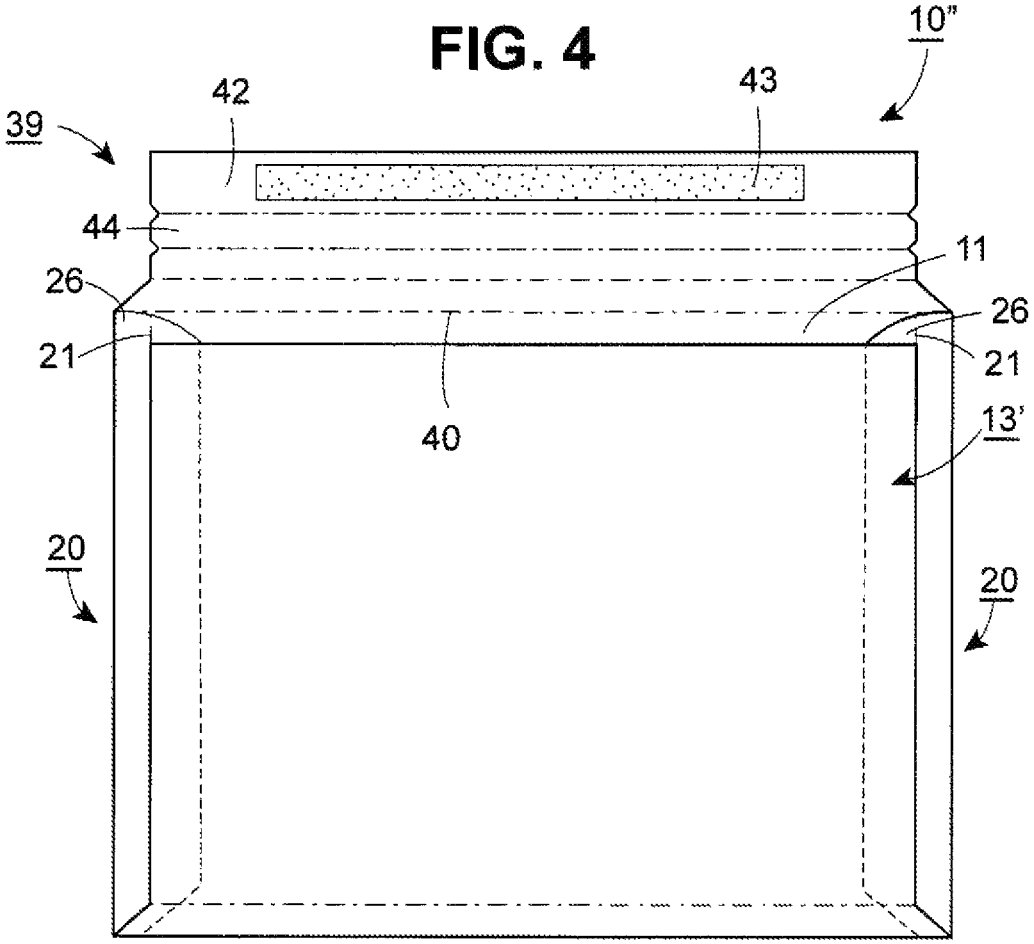
FIG. 4 illustrates a front view of a mailer made from the blank of FIG. 3.

Referring to FIG. 1, the blank 10 is of one-piece construction for making an expandable file holder (file jacket) as shown in FIG. 3 and may be made of paper, cardboard, corrugate, plastic or any other suitable material.

The blank 10 has a back panel 11 of rectangular shape with an upstanding tab 12 at an upper edge.

In addition, the blank 10 has a front panel 13 extending from a bottom edge 14 of the back panel 10 defined by a fold line for folding over the back panel 10 to define a pocket. The front panel 13 has a horizontally disposed score line 15 spaced from a bottom edge of the back panel 11 dividing the front panel 13 into a first rectangular section 16 extending from the back panel 11 and a second rectangular section 17 of smaller width than the first rectangular section 16. The first rectangular section 16 has an angular score line 18 at each respective longitudinal end thereof to define a triangular tab 19 or a rounded tab (not shown).

Alternatively, the front panel 13 may be divided by a horizontally disposed score line spaced from a bottom edge of the back panel 11 into a first trapezoidal section extending from the back panel 11 and a second rectangular section of smaller width than the first section. In addition, a pair of tabs extends from the front panel with each tab extending from a respective end of the trapezoidal section and the rectangular section of the front panel 13 and is of rhombic shape. When the front panel 13 is folded over the back panel 11 and the side flaps 20 are folded over the front panel 13 (FIG. 1B), each tab 19 lies over and within the contour of the first section 22 of a side flap 20.

The blank 10 also has a pair of side flaps 20. Each side flap 20 extends from a side edge of the back panel 11 and has a vertical score line 21 dividing the side flap 20 into a first section 22 extending from the back panel 11 and a second section 23. In addition, each side flap 20 has an angular score line 24 at one end of the first section 22 that extends from the back panel 11 and a horizontal score line 25 in the second section 23 that extends from the angular score line 24 to an edge of the flap 20. The angular score line 24 and horizontal score line 25 of each side flap 20 delimit a tab 26 with a rounded edge through which the vertical score line 21 passes.

As illustrated, the first section 22 of each side flap 20 has an angled end 27 at the bottom which extends at an angle which is continuous with the angular fold line 18 in the front panel 13. The second section 23 of each side flap 20 has a squared off end 28 with a rounded corner 29.

As illustrated, adhesive means 30 in the form of a glue line is disposed on the second section 23 of each side flap 20. The adhesive means 30 may also be in the form of glue dots and/or spots as well as of any suitable glue, pressure sensitive adhesive, coadhesive, and the like.

The back panel 11 is provided with a horizontal score line 31 spaced from the bottom edge 14, a pair of parallel vertical score lines 32 each of which extends from the horizontal score line and is spaced from a side edge of the back panel 11, and pairs of angular score lines 33, two of which extend from the horizontal score line 31 and a respective vertical score line 32 to a corner of the back panel 11 while the other two extend from a respective vertical score line 32 to an upper corner of the back panel 11. The end of each second section 23 of a side flap 20 is co-planar with the horizontal score line 31.

The front panel 13 is of a width equal to the spacing of the parallel vertical score lines 32 in the back panel.

Figure 1B:
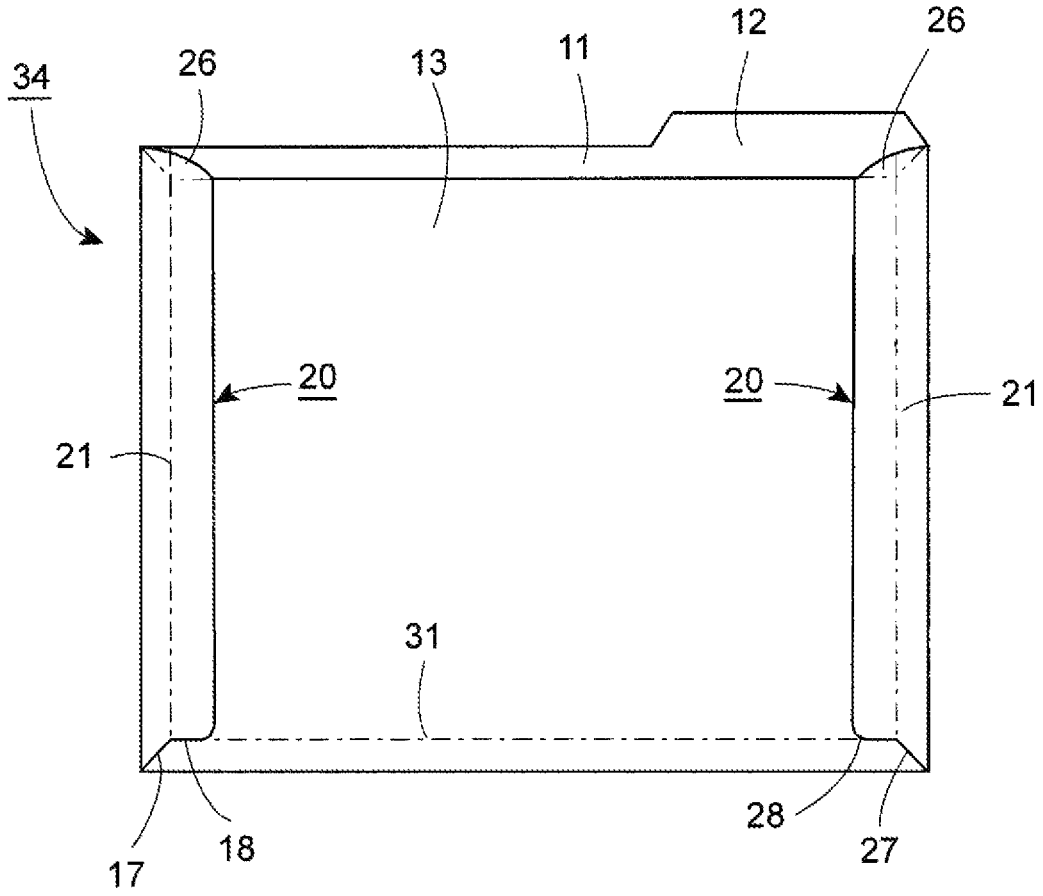
FIG. 1B illustrates a front view of a file folder made from the blank of FIG. 1.

Referring to FIG. 1B, when folded, the blank 10 forms a file folder 34.

Referring to FIG. 1, in order to form the folder 34, the front panel 13 is folded about the fold line 14 to overlie the back panel 11 with the top edge of the front panel 13 spaced inwardly of the top edge of the back panel 11. At this time, the fold line 15 of the front panel 13 overlies the horizontal score line 31 in the back panel 11. In addition, each angular score line 18 in the front panel 13 overlies an angular score line 33 in the back panel 11 and the front panel 13 extends between the pair of parallel vertical score lines 32 in the back panel 11 with the side edges of the front panel 13 overlying the vertical score lines 32. Also, the first rectangular section 16 of the front panel 13 is of the same width as the back panel 11 with each tab 19 overlying the back panel 11.

Next, each side flap 20 is folded over the front panel 13 with the adhesive 30 securing each flap 20 over the front panel 13. At this time, the angular score line 24 at the upper end of each side flap 20 overlies an angular score line 33 at the upper end of the back panel 11 and the angled end 27 of each side flap 20 overlies a tab 19 of the front panel 13 and is coincident with an angular score line 33 at the lower end of the back panel 11.

Once the side flaps 20 are secured in place, a pocket is formed between the back and front panels 11, 13 to receive materials, such as is conventional with file folders. Upon insertion of materials into the file folder 34, the front and back panels 11,13 move away from each other while remaining flat and parallel to each other. At the same time, the two sides and bottom of the file folder expand in a triangulated manner, i.e. the edges of the two sides and bottom of the file folder form a triangle. In this respect, the edges pivot about the score lines 15, 31, 21, 32. At the same time, the corners of the file holder 34 pivot about the score lines 18, 24 and 33.

As illustrated, the mouth of the folder 34 in FIG. 1B is recessed and is defined, in part, by the two tabs 26, each of which is rounded to avoid a sharp corner. In addition, with a score line 21 extending through a tab 26, each tab 26 may fold about the score line 21 to accommodate the thickness of materials placed in the pocket of the folder 34.

Alternatively, the score lines 31, 32, 33 may be omitted from the back panel as most of the capacity in the construction comes from the score lines in the side flaps 20 and from the die line and glue placement of the folder.

Figure 2:
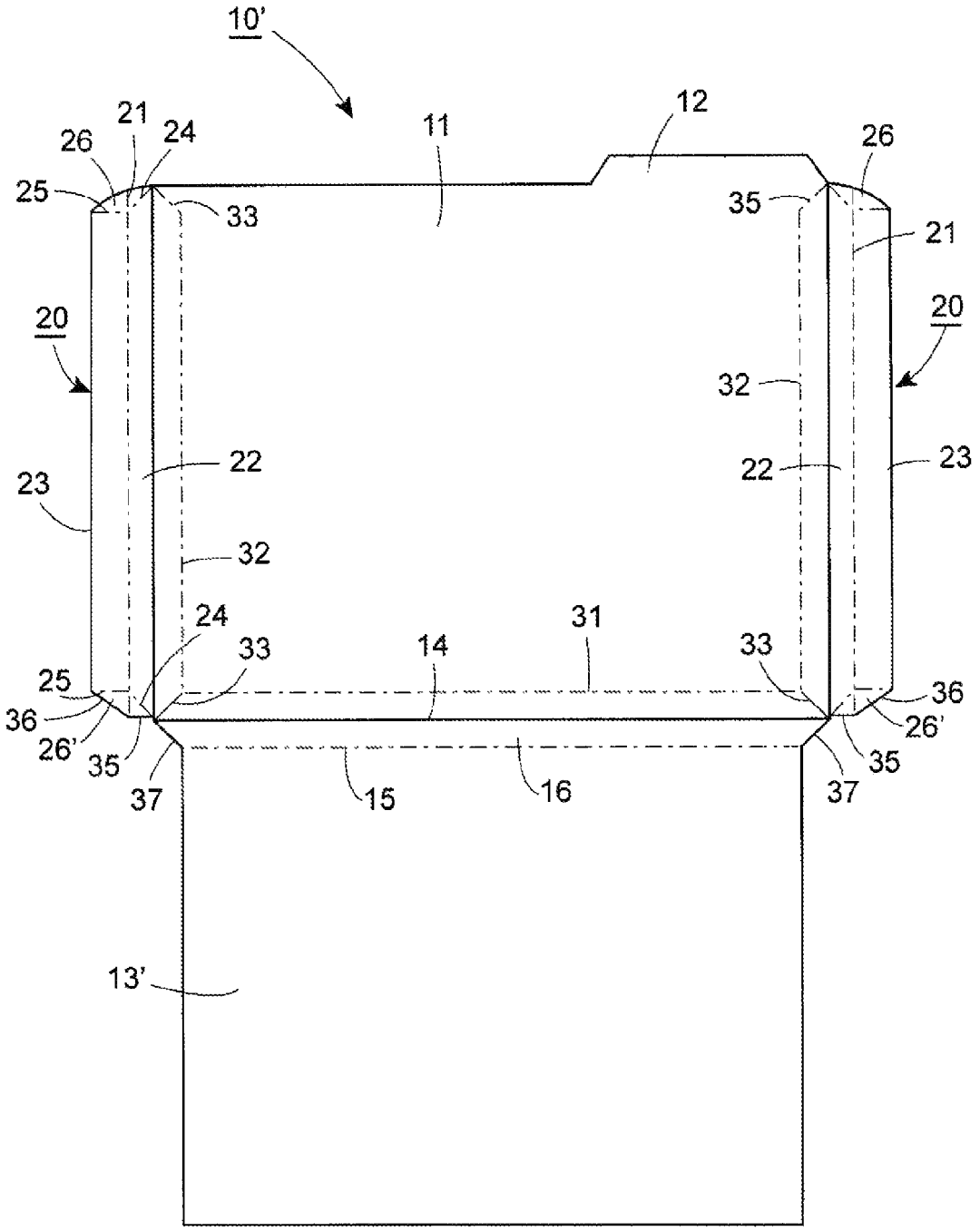
FIG. 2 illustrates a view of a modified blank used to make a pocket folder in accordance with the invention.

Referring to FIG. 2, wherein like reference characters indicate like parts as above, the blank 10' may be formed with a modified side flap 20 for folding under a front panel 13.

In this embodiment, the lower end of each side flap 20 has an angular score line 24 at the lower end of the first section 22 that extends from the back panel 11 and a horizontal score line 25 in the second section 23 that extends from the angular score line 24 to an edge of the flap 20. The angular score line 24 and horizontal score line 25 in the lower end of each side flap 20 delimit a tab 26' through which the vertical score line 21 passes. In distinction to the tab 26 at the top of a side flap 20, the tab 26' is delimited by a horizontal edge 35 on the lower end of the first section 22 of each side flap 20 and an angled edge 36 on the lower end of the second section 23 of each side flap 20. As shown, the horizontal edge 35 is located slightly above the fold line 14 at the bottom edge of the back panel 11.

Also, the adhesive 30 is placed on the underside of the second section 23 of each side flap 20.

The front panel 13' is also modified so that the first section 16 of the panel 13' is of trapezoidal shape with angled edges 37.

Figure 2B:
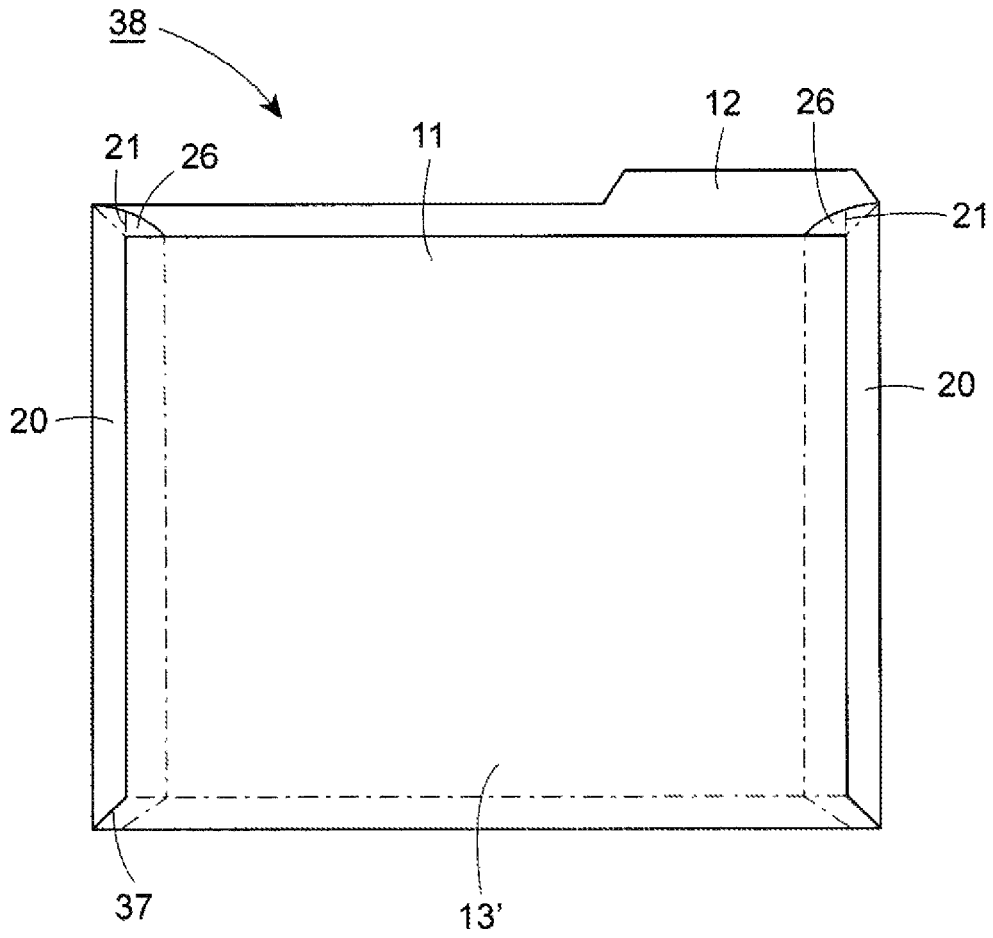
FIG. 2B illustrates a front view of a file folder made from the blank of FIG. 2.

Referring to FIG. 2B, when folded, the blank 10' forms a file folder 38.

Referring to FIG. 2, in order to form the folder 38, each side flap 20 is folded over the back panel 11 with the adhesive 30 facing upwardly. At this time, the angular score lines 24 of each side flap 20 overlie the angular score lines 33 of the back panel 11; the horizontal score line 25 of the tab 26 at the lower end of each side flap 20 overlies the horizontal score line 31 in the back panel 11; and the vertical score lines 21 in each side flap 20 overlie the vertical score lines 32 in the back panel 11.

Next, the front panel 13' is folded about the fold line 14 to overlie the back panel 11 with the top edge of the front panel 13 spaced inwardly of the top edge of the back panel 11 and with the adhesive 30 securing each flap 20 to the underside of the front panel 13. At this time, each side edge of the front panel 13 is coincident with a vertical score line 21 of a respective side flap 20; and the top edge of the front panel 13 is coincident with the horizontal score lines 25 of the tabs 26 at the top of each side flap 20.

As illustrated in FIG. 2B, each lower corner of the folder 38 is formed of three overlying plies, namely, a corner of the back panel 11, an overlying tab 26 of a side flap 20 and an end of the trapezoidal section 16 of the front panel 13'.

Thus, upon expansion of the file folder in use, the bottom corners maintain their integrity without any "popping out" of the corner from the file folder when filled to capacity.

The shape and placement of the tabs 26 allow materials to slide into the folder without catching or jamming.

Various modifications may be made in the blanks 10, 10' within the scope of the invention. For example, the back panels 11 may be formed without score lines. Also, the upstanding tab 12 may be positioned at any point along the upper edge of the back panel 11 or may be omitted or may extend completely across the top edge of the back panel 11.

Referring to FIG. 3, wherein like reference characters indicate like parts as above, the blank 10", otherwise formed as in the embodiment of FIG. 2, may be formed with a closure panel 39 extending from the back panel 11 for folding over the back panel 11 to close the pocket between the back panel 11 and front panel 13', for example, to contain materials in a closed condition for filing in a filing cabinet or the like. As illustrated, the closure panel 39 has a horizontally disposed score line 40 dividing the closure panel 39 into a trapezoidal section 41 extending from the back 11 panel and a second rectangular section 42. In this embodiment, the closure flap 39 may be folded over a filled file folder in an unsecured manner or another means, such as a ribbon, button and string, Velcro or the like, may be applied to secure the closure flap 39 in place.

The closure flap 39 may be folded down and inserted into the pocket between the back panel 11 and front panel 13' during manufacturing and packaging for sale allowing for a file jacket to have extended functionality whereby the closure flap 39 could be pulled out and sealed for shipping purposes.

Alternatively, the blank 10" may be used to make a mailer. In this embodiment, the rectangular section 42 of the closure panel 39 includes an adhesive 43 for adhering of the closure panel 39 to the back panel 13' to close the pocket. In addition, the closure panel 39 includes a horizontally disposed integral tear-off strip 44 between the adhesive 43 and the trapezoidal section 41 of the closure panel 39 to allow opening of the closed and sealed mailer.

The above described embodiments are of a file folder that is closed on three sides thereby containing materials in a secure manner. A file folder that is closed on two sides, for example for use in the medical industry, may also be made. For example, the blank 10 of FIG. 1 may be made without the side flap 20 on the right-hand side as viewed to allow for an open side.

Further, the adhesive used for closure depends on the application. On paper envelopes, use can be made of remoist, peel and seal or latex adhesive. Velcro and eyelet string closures can also be used. On heavier substrates all closures can be used.

The invention thus provides a file folder that presents a footprint that does not expand outwardly thereby allowing the file folder when filled to fit into a standard or legal file cabinet in a smooth and easy manner. This footprint also does not expand inwardly as an accordion pleat does, thereby allowing materials to be inserted without impediment.

The invention also provides a one piece blank that can be readily folded into a file folder in an economic manner or modified to form a mailer.

What is claimed is:

1. An expandable file holder comprising a back panel of rectangular shape;

a front panel extending from a bottom edge of said back panel and folded over said back panel with a top edge thereof spaced inwardly from a top edge of said back panel to define a mouth of an open pocket therebetween, said front panel having a horizontally disposed score line spaced from a bottom edge of said back panel dividing said front panel into a first rectangular section extending from said back panel and only a second rectangular section of smaller width than said first rectangular section extending from said first rectangular section, said first rectangular section having an angular score line at each respective longitudinal end thereof to define a triangular tab;

a pair of side flaps, each said side flap extending from a side edge of said back panel and having a vertical score line dividing said side flap into a first section extending from said back panel and a second section; and adhesive means securing said second section of each said flap directly to said front panel.

2. A file holder as set forth in claim 1 wherein each said side flap is adhesively secured over said front panel.

3. A file holder as set forth in claim 2 wherein said adhesive means is disposed between said second section of each said flap and said front panel.

4. A file holder as set forth in claim 1 wherein each said side flap has an angular score line at one end of said first section extending from said back panel and a horizontal score line in said second section extending from said angular score line to an edge of said respective flap; said angular score line and said horizontal score line of said respective side flap delimiting a tab.

5. A file holder as set forth in claim 1 wherein each said side flap is adhesively secured under said front panel.

6. A file holder as set forth in claim 5 wherein each said side flap has an angular score line at each end of said first section extending from said back panel and a horizontal score line at each end of said second section extending from a respective angular score line to an edge of said respective flap; each respective angular score line and respective horizontal score line of said respective side flap delimiting a tab.

7. A file holder as set forth in claim 1 wherein said back panel has an upstanding tab at said top edge thereof.

8. An expandable file holder comprising a back panel of rectangular shape having a horizontal score line spaced from a bottom edge thereof, a first vertical score line extending from said horizontal score line and spaced from a first side edge thereof, a second vertical score line extending from said horizontal score line in parallel to said first vertical score line and spaced from a second side edge thereof, a first angular score line extending from said horizontal score line and said first vertical score line and a second angular score line extending from said horizontal score line and said second vertical score line;

a front panel extending from a bottom edge of said back panel and folded over said back panel with a top edge thereof spaced inwardly from a top edge of said back panel to define a mouth of an open pocket therebetween, said front panel having a horizontally disposed score line spaced from a bottom edge of said front panel dividing said front panel into a first rectangular section extending from said back panel and only a second rectangular section extending from said first rectangular section, said first rectangular section having an angular score line at each respective longitudinal end thereof to define a triangular tab and said second rectangular section being of a width equal to a horizontal distance between said first vertical score line and said second vertical score line;

a pair of side flaps, each said side flap extending from a side edge of said back panel and having a vertical score line dividing said side flap into a first section extending from said back panel and a second section; and adhesive means securing said second section of each said flap to said front panel.

9. A file holder as set forth in claim 8 wherein each said side flap is adhesively secured over said front panel.

10. A file holder as set forth in claim 9 wherein said adhesive means is disposed between said second section of each said flap and said front panel.

11. A file holder is set forth in claim 8 wherein said back panel has an upstanding tab at said top edge thereof.

12. A file holder as set forth in claim 8 wherein each said side flap has an angular score line at one end of said first section extending from said back panel and a horizontal score line in said second section extending from said angular score line to an edge of said respective flap; said angular score line and said horizontal score line of said respective flap delimiting a tab.

13. A file holder as set forth in claim 8 wherein each said side flap has an angular score line at each end of said first section extending from said back panel and a horizontal score line at each end of said second section extending from a respective angular score line to an edge of said respective flap; each respective angular score line and respective horizontal score line of said respective flap delimiting a tab.

14. A blank of one-piece construction comprising a back panel of rectangular shape;

a front panel extending from a bottom edge of said back panel for folding over said back panel to space a top edge thereof inwardly from a top edge of said back panel to define a mouth of an open pocket therebetween, said front panel having a horizontally disposed score line spaced from a bottom edge of said back panel dividing said front panel into a first rectangular section extending from said back panel and only a second rectangular section of smaller width than said first rectangular section extending from said first rectangular section, said first rectangular section having an angular score line at each respective longitudinal end thereof to define a triangular tab;

a pair of side flaps, each said side flap extending from a side edge of said back panel and having a vertical score line dividing said side flap into a first section extending from said back panel and a second section; and adhesive means on said second section of each said flap for securing said second section of each said side flap directly to said front panel.

15. A blank as set forth in claim 14 wherein each said side flap has an angular score line at one end of said first section extending from said back panel and a horizontal score line in said second section extending from said angular score line to an edge of said respective flap; said angular score line and said horizontal score line of said respective side flap delimiting a tab.

16. A blank as set forth in claim 14 wherein each said side flap has an angular score line at each end of said first section extending from said back panel and a horizontal score line at each end of said second section extending from a respective angular score line to an edge of said respective flap; each respective angular score line, respective horizontal score line and said vertical score line of said respective side flap delimiting a tab.

17. A blank as set forth in claim 14 wherein said back panel has an upstanding tab at said top edge thereof.

18. A blank as set forth in claim 14 further comprising a closure panel extending from said back panel, said closure panel having a horizontally disposed score line dividing said closure panel into a trapezoidal section extending from said back panel and a second section; and a fold line disposed between said back panel and said closure panel.

19. A blank as set forth in claim 18 further comprising an adhesive on said second section of said closure panel for adhering to said rectangular section of said front panel to close said pocket.

20. A blank as set forth in claim 19 wherein said closure panel includes a horizontally disposed integral tear-off strip between said adhesive and said trapezoidal section of said closure panel.

21. A blank of one-piece construction comprising a back panel;

a front panel extending from a bottom edge of said back panel for folding over said back panel to space a top edge thereof inwardly from a top edge of said back panel to define a mouth of an open pocket therebetween, said front panel having a horizontally disposed score line spaced from a bottom edge of said back panel dividing said front panel into a first section extending from said back panel and only a second rectangular section of smaller width than said first section, said first section extending from said first rectangular section having an angular score line at one longitudinal end thereof to define a tab extending from said first section;

a side flap extending from one side edge of said back panel and having a vertical score line dividing said side flap into a first section extending from said back panel and a second section; and adhesive means on said second section of said side flap for securing said second section of each said side flap directly to said front panel.

22. A blank as set forth in claim 21 wherein said tab is one of a triangular shape, a rounded shape and a rhombic shape.

23. An expandable file holder comprising a back panel;

a front panel extending from a bottom edge of said back panel and folded over said back panel with a top edge thereof spaced inwardly from a top edge of said back panel to define a mouth of an open pocket therebetween, said front panel having a horizontally disposed score line spaced from a bottom edge of said back panel dividing said front panel into a first section extending from said back panel and only a second rectangular section of smaller width than said first section, said first section extending from said first rectangular section having an angular score line at one longitudinal end thereof to define a tab extending from said first section;

a side flap extending from one side edge of said back panel and having a vertical score line dividing said side flap into a first section extending from said back panel and a second section; and adhesive means securing said second section of said flap to said front panel.

* * * * *